US010726659B2

(12) United States Patent
Pececnik

(10) Patent No.: US 10,726,659 B2
(45) Date of Patent: Jul. 28, 2020

(54) HOLOGRAPHIC AMUSEMENT/WAGERING SYSTEM WITH VEHICULAR USER TRANSPORT

(71) Applicant: Interblock d.d., Menges (SI)

(72) Inventor: Joze Pececnik, Kamnik (SI)

(73) Assignee: INTERBLOCK D.D., Menges (SI)

( * ) Notice: Subject to any disclaimer, the term of this patent is extended or adjusted under 35 U.S.C. 154(b) by 29 days.

(21) Appl. No.: 15/917,521

(22) Filed: Mar. 9, 2018

(65) Prior Publication Data

US 2018/0261040 A1 Sep. 13, 2018

Related U.S. Application Data

(63) Continuation of application No. 13/915,902, filed on Jun. 12, 2013, now Pat. No. 9,916,717.

(51) Int. Cl.
*G07F 17/32* (2006.01)
*A63G 7/00* (2006.01)

(52) U.S. Cl.
CPC ..... *G07F 17/3211* (2013.01); *A63G 7/00* (2013.01); *G07F 17/3272* (2013.01)

(58) Field of Classification Search
None
See application file for complete search history.

(56) References Cited

U.S. PATENT DOCUMENTS 4,767,117 A 8/1988 Maio
5,785,592 A 7/1998 Jacobsen
6,007,338 A 12/1999 DiNunzio et al.
6,095,926 A 8/2000 Hettema et al.
6,386,984 B1 5/2002 Hara et al.
6,409,602 B1 6/2002 Wiltshire et al.
7,971,537 B2 7/2011 Verl et al.
8,177,368 B2 5/2012 O'Connell et al.
8,578,857 B2 11/2013 Crawford et al.
8,727,896 B2 5/2014 Frolov
(Continued)

OTHER PUBLICATIONS

Pececnik, Three-Dimensional Auditorium Wagering System, U.S. Appl. No. 13/631,195, filed Sep. 28, 2012.
(Continued)

*Primary Examiner* — Ronald Laneau
(74) *Attorney, Agent, or Firm* — BakerHostetler

(57) ABSTRACT

A virtual entertainment system supports holographic display for multiple players. The system has multiple viewing screens, each screen displaying thematic events. Multiple carriages have seating supporting multiple audience members. A track system supports and directs the multiple carriages through a sequence of the multiple viewing screens. A processor accesses memory of more than one theme and multiple holographic data content related to a single theme to each of the video display screens. A theme selecting input system provides a signal identifying a single theme for display to a single carriage as it moves along the track system. The processor identifies location of individual carriages with respect to individual viewing screens. The processor provides thematic content of the single identified theme to the at least two players in the individual respective ones of the multiple carriages. The theme may be gaming activity and include gaming input.

20 Claims, 5 Drawing Sheets

(56) References Cited

U.S. PATENT DOCUMENTS

| | | | | |
|---|---|---|---|---|
| 9,915,920 | B2 * | 3/2018 | Oh | G06F 3/1423 |
| 2002/0068640 | A1 | 6/2002 | Uemura et al. | |
| 2003/0106455 | A1 | 6/2003 | Weston | |
| 2006/0100017 | A1 | 5/2006 | Lind | |
| 2006/0293110 | A1 | 12/2006 | Mendelsohn | |
| 2007/0078016 | A1 | 4/2007 | Henry et al. | |
| 2007/0167239 | A1 | 7/2007 | O'Rourke | |
| 2009/0098925 | A1 | 4/2009 | Gagner et al. | |
| 2009/0143155 | A1 | 6/2009 | Werner | |
| 2009/0187125 | A1 | 7/2009 | Tran et al. | |
| 2010/0160054 | A1 | 6/2010 | Henry | |
| 2011/0149249 | A1 | 6/2011 | O'Connell et al. | |
| 2013/0032053 | A1 | 2/2013 | Stoker | |
| 2013/0045804 | A1 | 2/2013 | Ruke | |
| 2013/0084984 | A1 | 4/2013 | Gagner et al. | |
| 2014/0071229 | A1 * | 3/2014 | Weerasinghe | H04N 21/26258 348/40 |
| 2014/0160541 | A1 * | 6/2014 | Kim | G03H 1/0011 359/2 |
| 2018/0367833 | A1 * | 12/2018 | Weerasinghe | H04N 21/6547 |

OTHER PUBLICATIONS

Schaufler and Sturzlinger, A Three Dimensional Image Cache for Virtual Reality, (http://www.cs.princeton.edu/courses/archive/spr01/cs598b/papers- /schaufler96.pdf),GUP Johannes Kepler Universitat Linz, Altenbergerstr.69, A-4040 Linz, Austria/Europe. Downloaded from the referenced web address Jun. 12, 2013.

* cited by examiner

HOLOGRAPHIC AMUSEMENT/WAGERING SYSTEM WITH VEHICULAR USER TRANSPORT

CROSS REFERENCE TO RELATED APPLICATIONS

This application is a continuation of U.S. patent application Ser. No. 13/915,902, filed Jun. 12, 2013, now U.S. Pat. No. 9,916,717, issued Mar. 13, 2018, the contents of which is incorporated herein by reference in its entirety.

BACKGROUND OF THE INVENTION

1. Field of the Invention

The present invention relates to the field of entertainment, including wagering entertainment, and to the field of traveling audience participation on a multiple screen image display.

2. Background of the Art

Gaming systems have advanced dramatically in their technical content over the past twenty years. Originally, casino gaming systems were effectively under manual control (e.g., playing cards, roulette wheels, candy wheels, and dice) or were very simple geared mechanical systems (e.g., slot machines). The susceptibility of gaming systems under complete manual control or simple mechanical control to fraud or dishonest manipulation has facilitated movement of the industry into more electronic systems where there is less direct human interaction with the random event producing components.

For example, playing cards are electromechanically shuffled, virtual playing cards are chosen by a random number generator and displayed on a screen, dice and roulette outcomes are generated by a random event/number generator, and slot machines have become primarily electronic systems with a process and random number generator providing symbols displayed as frames having the appearance of a slot machine face on a a display screen.

With newer generations having been exposed to or raised with electronic games, there has been a greater acceptance by those generations of gaming systems that are completely electronic. This has enabled the acceptance of numerous types of wagering systems that would have been unacceptable to earlier generations of players.

Original gaming machines were placed on countertops for individual players to use. Individual slot machines with handles were then placed on the floor. Individual seating for the slot machines were then added. Keno is often played in a stadium setting, and some video games are now being played in a multi-seat or even stadium setting. There are numerous objectives with these systems in providing novel ambiance for play and yet maintaining the ability to play games that players enjoy and are familiar with.

SUMMARY OF THE INVENTION

A virtual entertainment system supports holographic display for multiple players. The system has multiple viewing screens, each screen displaying thematic events. Multiple carriages have seating supporting multiple audience members. A track system supports and directs the multiple carriages through a sequence of the multiple viewing screens. A processor accesses memory of more than one theme and multiple holographic data content related to a single theme to each of the video display screens. A theme selecting input system provides a signal identifying a single theme for display to a single carriage as it moves along the track system. The processor identifies location of individual carriages with respect to individual viewing screens. The processor provides thematic content of the single identified theme to the at least two players in the individual respective ones of the multiple carriages. The theme may be gaming activity and include gaming input.

DETAILED DESCRIPTION OF THE FIGURES

Figure 1:
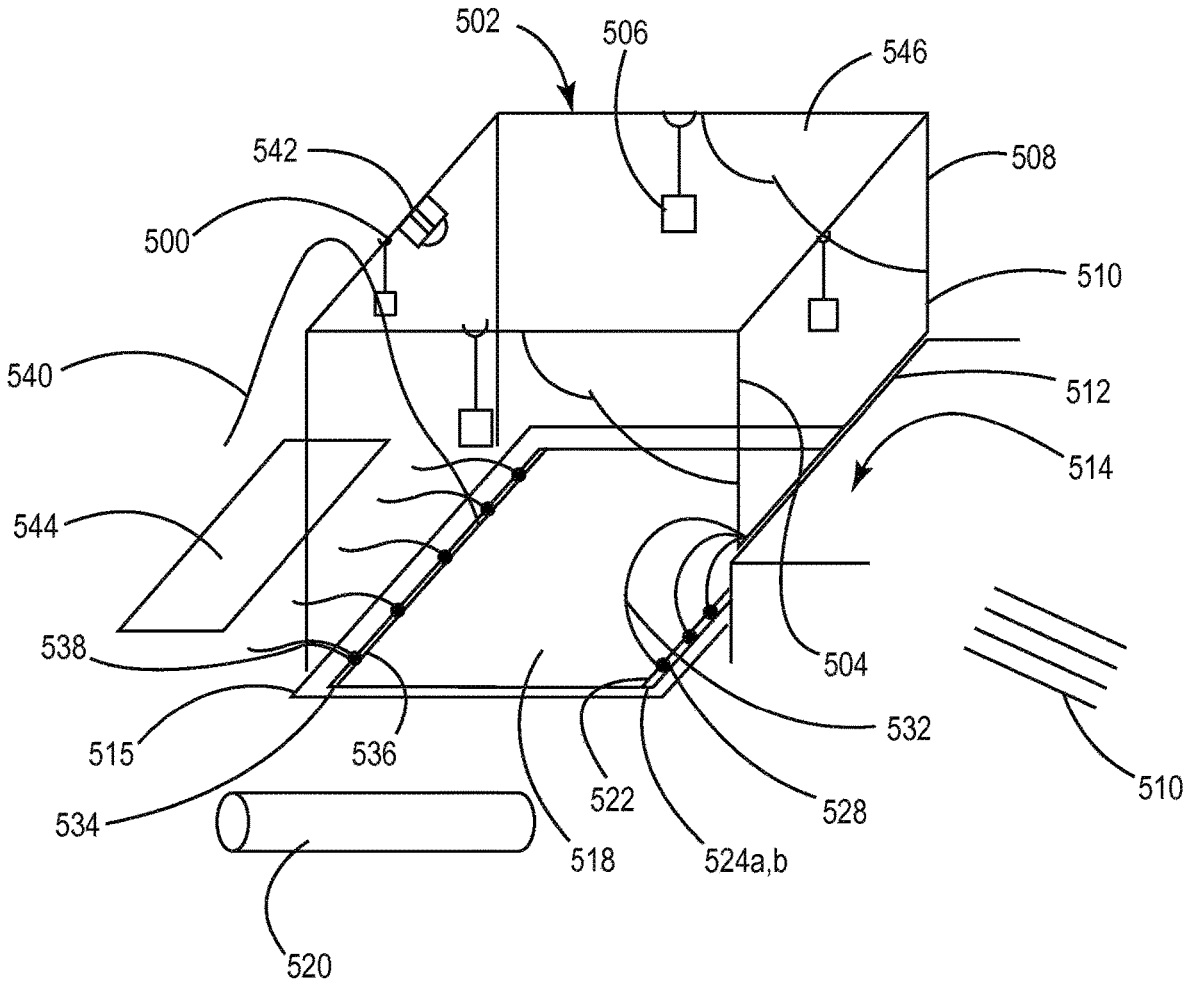
FIG. 1 is a schematic view of a projection apparatus according to the teachings of the Prior Art represented by U.S. Pat. No. 8,177,368.

A virtual entertainment system supports holographic display for multiple players. The system has multiple viewing screens, each screen displaying thematic events. Multiple carriages have seating supporting multiple audience members. A track system supports and directs the multiple carriages through a sequence of the multiple viewing screens. A processor accesses memory of more than one theme and multiple holographic data content related to a single theme to each of the video display screens. A theme selecting input system provides a signal identifying a single theme for display to a single carriage as it moves along the track system. The processor identifies location of individual carriages with respect to individual viewing screens. The processor provides thematic content of the single identified theme to the at least two players in the individual respective ones of the multiple carriages. The theme may be gaming activity and include gaming input.

The virtual entertainment system may also have player input controls that are in wireless communication to the processor to convey requested theme input to the processor; and the processor providing thematic content to the individual respective ones of the multiple carriages and receiving thematic input from individual player controls for each of the at least two players in the individual respective ones of the multiple carriages. The virtual entertainment system may have themes in memory include sets of multiple and different images selected from the group consisting of animals, sports activity, plant displays, scenery, science exhibits, decorated rooms, and entertainment acts.

A gaming system supports play for multiple players on a displayed game. The system may be constructed with multiple viewing screens, each viewing screen displaying gaming events and gaming outcomes. The individual viewing screens may be in a single format or the various ones of the multiple screens may each have different viewing formats. In a preferred embodiment, multiple ones, most or all of the viewing screens are holographic imaging systems. Other formats which may be used include two-dimensional viewing systems (e.g., CRT, LED, Plasma or other flat screen technology) or three-dimensional viewing screens or systems, such as flat screens with three-dimensional viewing capability (with or without glasses). The term screen, unless specifically stated, does not refer to a standard flat screen, but includes the use of multiple layers, multiple oriented screens, air suspended particulates (for reflecting laser radiation), and the like.

The multiple carriages have seating supporting at least two players. To make the system more economically valuable, the carriages may carry four or more, six or more, and eight or more individuals. Seating on the individual carriages should be oriented (at least two tiers, for example) so that each seated passenger/player has an uninterrupted view of each viewing screen. When the individual carriages stop at each individual viewing screen, they are stopped in a single fixed position which provides clear line of sight to the individual viewing screens for each passenger.

A track system supports and directs the multiple carriages and directs the multiple carriages through a sequence of the multiple viewing screens. The track system may be monorail or dual track or multiple tracks with more than two rails. The stop points of the carriages on the rails is at a position offering the best direct or shared direct view of the individual display screens at each stop point. This may be accomplished by positioning both the tracks and the screens at optimal positions at these points. A preferred method is to have the carriages on a carrying frame, so that the seating on the carriage can be rotated about the carrying frame. In this way, the carriages may easily rotate to the appropriate position at each stop point. There may also be alignment sensors of various types on the carriages to assure they are stopped at the appropriate orientation to each screen. The sensors may sense position on the track and orientation of the carriage on the track with respect to the screens. The sensed information would be fed to the processor controlling the carriage movement and the processor would direct movement of the carriage (e.g., by signals to the motor to move the carriage system or rotate the carriage with respect to the carrying frame. The sensors may also be positions on the carriage to sense light transmission from the individual viewing screens. Light from the individual screens may include a transmission of an alignment signal, such as a stream of collimated light (e.g., laser light) or a pattern of light so that the signals received by the sensors and either locally processed on each carriage (e.g., by a carriage processor or local logic (ASIC or FPGA) to identify its position, and that information would be transmitted to the carriage movement control processor to provide information which can be used by that processor to direct movement, orientation or rotation of the carriage components to properly align the carriage and the individual screens.

In the gaming mode of play, there is a processor having a game controller that provides random game event outcomes and transmits video information related to the random game event outcomes to each of the video display screens. It is a commercially and technically innovative aspect of the present technology that the individual carriages (and hence the players in them) can access different images and/or different games as they pass along the track. A main controller of player input on each carriage communicates with the (central processor) to identify the game that will be played at the first display screen (and thereafter all visual display screens where the carriage stops) and/or at each individual display screen. For example, an RFID, wifi communication device, iPad, Tablet, smartphone, dedicated processor on each carriage, individual terminals on the carriage, etc. will select games to be played at each carriage stop position (one slot game may be played at the first position, and another entry during transit or after stopping at the next stop position may identify single line video poker, and a the entry at the third stop position may designate multiline video poker, etc. It is also possible that the first identified game must be played at every stop, or that it takes a majority of votes/requests among all the active players to change the game at any position.

There are numerous ways in which the games or shows may be chosen, but their data storage should be in communication (directly or ultimately) in series or parallel) with the main game computer. This is because the central gaming processor should exercise the primary storage function for accounting information and each individual player information. An additional function that may be provided on the system, because space would be at a premium, is to require in a gaming environment that each player is required to add a minimum amount of credit to ride on the carriage and if that player position is not wagering at a second minimum required rate of play, that player's account will be debited a fixed amount or a variable amount at specific intervals during low rate of play.

The player input controls are in wireless communication to the processor to convey wagering input to the processor. Any form of communication that is ultimately received by the central game processor may be used. Communication may even be transported through a physical or hardwired system, even transmitting data through the tracks along dedicated wavebands or frequencies. Each individual player places wagers against the house (the central gaming processor) and/or may play games competing against other players. Any game may be played that is available to electronic formatting. Both wagering games and other interactive games between players or groups of players.

The processor identifies location of individual ones of the multiple carriages with respect to individual respective ones of the viewing screens. Aspects of this technology have already been discussed.

The processor provides gaming content to the individual respective ones of the multiple carriages and receiving wagering input from individual player controls for each of the at least two players in the individual respective ones of the multiple carriages. The processor also resolves individual wagers, bonuses, and total wager resolutions and credit balances for each player Groups of players may also play against other groups of players, with totals of each group or the highest score (or scores) from each group winning a bonus award.

The gaming system may have a first multiple screen has feed from a processor configured to feed individual and single game content to a single one of the multiple carriages when it is positioned in front of the first multiple screen. This type of system may also have the processor configured to accept multiple player input from the at least two players on wagering on the single game content at the first multiple screen. The gaming system of may have the multiple viewing screens comprise at least 4, at least 6, at least 8 or at least 10 viewing screens and the multiple carriages comprise at least four, six, eight, ten or more carriages. There may be more carriages than wagering stations or vice-versa. If there are more carriages, they may be lined up for entry and discharge from the viewing or wagering path to facilitate entry, exit and organization of wagering selections. Wagering selections, as they must be relevant to each individual stop position (although an option is to have two side-by-side holographic wagering possibilities) should be confirmed before or at the moment the carriage makes its first stop. This is preferably done for the first visual play stop before the carriage enters actively on the track and definitely before the first stop. This is preferably done before entry into the housing for the multiple screens or stopping at the first display screen. A single player position on each carriage may be used to enter the gaming selection program, or the processor may take a "vote" by the players to select all of the games or the games at each position, or the processor may weigh each vote and apportion the distribution of games along the path. For example, if there are eight player positions on a carriage and the eight "votes" are distributed as 4 votes for single line video poker, 2 votes for three-line video poker, and one vote each for double bonus poker and deuces wild poker, the visual displays screens may be all single line video poker (the majority vote), or four stops may be single line poker, two stops three-line poker, and one stop each for double bonus poker and deuces wild poker.

The processor may be configured to receive player input from each of the multiple carriages at a beginning point along a pathway on the track system so that a single format of game content is provided along the track system at each of the multiple viewing screens. The processor may be configured to receive player input from each of the multiple carriages at any point along a pathway on the track system so that individual formats of game content are provided along the track system at each of the multiple viewing screens.

A preferred display system and a preferred gaming system is disclosed in applicant's copending U.S. patent application Ser. No. 13/631,195, filed Sep. 28, 2012, and titled "THREE-DIMENSIONAL AUDITORIUM WAGERING SYSTEM."

This holographic wagering and display technology includes a gaming system that provides a wagering venue for multiple wagering positions and a three-dimensional or holographic display of game events. The basic equipment desirable for performing the process and forming the system may include:

a) a processor configured to execute code to simulate a physical random gaming event outcome using a random number generator. A commercially available gaming processor or central processor may be used. The processor may be provided with memory, flash memory, EPROM, EEPROM, RAM, ROM, input/output ports, hard-wire or wireless communication enabling capability and the like.

b) memory storing three-dimensional video displayable image data of a device useful in providing the physical random gaming event outcome. The displayable image data may be segmented or may be in a continuous format. In segmented format, a first generic image data set would display a generic movement of the virtual random event generations system would be shown. For example, a first generic segment of a spinning roulette wheel with revolving ball around the edge may be shown, bouncing dice, spinning candy wheel, cards being dealt face down, and the like can be show. An individual, specific segment may be transferred from memory to the three-dimensional display system at the end of the generic segment. The individual, specific display data segment would then show the virtual image of the random number generated determined outcome for the game event. This method reduces the total amount of data that must be stored in displaying outcomes. This is particularly important where a single processor stores multiple games thereon.

c) a three-dimensional video display system having a three-dimensional image display field viewable within an at least 30 degree field of view. The field of view may be larger to accommodate more displays. Depending upon the size of the display, the nature of the display system, its inherent or modifiable available angle of vision and the number and position of player input terminals, the field of view may be required to be up to 180 degrees or 360 degrees. It is also possible for multiple display systems to be arranged to expand the functional field of view available from a single component system.

d) at least two player input terminals and seating for the player input terminals within the at least 30 degree field of view;

wherein the processor is configured i) to identify a wager from a specific player input terminal, ii) to initiate generation of an event outcome in a random event outcome game, iii) to generate an event outcome simulating a physical random event generating outcome; iv) to select image data from the memory of a three-dimensional event outcome in which the generated simulated physical random event outcome is shown; v) displaying the selected image data; and resolving the wager based upon the generated event outcome.

The three-dimensional imaging system may include a separate computer/processor or additional capacity in the underlying computer for the system. In computers, 3-D (three dimensions or three-dimensional) describes an image that provides the perception of depth. When 3-D images are made interactive so that users feel involved with the scene, the experience is called virtual reality. In a personal computer system, the user usually needs a special plug-in viewer for the Web browser to view and interact with 3-D images. Virtual reality experiences may also require additional equipment. 3-D image creation can be viewed as a three-phase process of: tessellation, geometry, and rendering. In the first phase, models are created of individual objects using linked points that are made into a number of individual polygons (tiles). In the next stage, the polygons are transformed in various ways and lighting effects are applied. In the third stage, the transformed images are rendered into objects with very fine detail. Popular products for creating 3-D effects include Extreme 3D, LightWave 3D, Ray Dream Studio, 3D Studio MAX, Softimage 3D, and Visual Reality. The Virtual Reality Modeling Language (VRML) allows the creator to specify images and the rules for their display and interaction using textual language statements.

High speed display of three-dimensional images from caches of memory are enabled by techniques such as those of (http://www.cs.princeton.edu/courses/archive/spr01/cs598b/papers/schaufler96.pdf), A Three Dimensional Image Cache for Virtual Reality, Gernot Schaufler and Wolfgang Stürzlinger, GUP, Johannes Kepler Universitat Linz, Altenbergerstr.69, A-4040 Linz, Austria/Europe.

A particular imaging system within the scope of the present technology includes a gaming system for providing a wagering venue for multiple wagering positions. The system may have:

a) a processor configured to execute code to simulate a physical random gaming event outcome using a random number generator;

b) memory storing three-dimensional video displayable image data of a device useful in providing the physical random gaming event outcome;

c) a three-dimensional video display system having a three-dimensional image display field viewable within an at least 30 degree field of view;

d) at least two player input terminals and seating for the player input terminals within the at least 30 degree field of view;

wherein the processor is configured i) to identify a wager from a specific player input terminal, ii) to initiate generation of an event outcome in a random event outcome game, iii) to generate an event outcome simulating a physical random event generating outcome; iv) to select image data from the memory of a three-dimensional event outcome in which the generated simulated physical random event outcome is shown; v) to display the selected image data; and vi) to resolve the wager based upon the generated event outcome;

wherein the three-dimensional image display system comprises an image display apparatus, comprising: an image source, a mount, an at least partially transparent screen, and a pigmented reflective member, the mount being arranged to retain the screen under tension, such that the screen is inclined at an angle with respect to a plane of emission of light from the image source; the screen having a front surface arranged such that light emitted from the image source is reflected therefrom; and the image source being arranged to provide an image such that light forming the image impinges upon the screen such that a virtual image is created from light reflected from the screen, the virtual image appearing to be located behind the screen, the apparatus further comprising a stage, and a stage background, the screen being provided in front of the stage, wherein a plurality of light sources are arranged to illuminate at least part of at least one of the stage or stage background, and the pigmented reflective member being provided in an optical pathway between the image source and the screen and being operative to reflect only light from part of the visible spectrum such that the pigmented reflective member reduces a milky hue associated with light where there is no image to be presented surrounding a Pepper's Ghost image to compensate for variations in levels of unwanted light hitting the surface of the screen; wherein an angle of inclination of the pigmented reflective member with respect to the plane of emission of light from the image source is variable.

The gaming system may have at least two of the player input terminals comprise free-standing individual gaming terminals with player input controls or at least two banked gaming terminals and at least one of the player input terminals may comprise a portable handheld device in wireless communication with the processor. There may be multiple rows of multiple player input controls within the 30 degree field of view, creating an arena or amphitheater setting.

The processor may be configured with software in memory to execute game rules of at least two different games selected from the group consisting of roulette, bingo, dice games, playing card games and spinning wheel games. The processor may be configured with software in memory to execute game rules of at least two different games selected from the group consisting of roulette, bingo, dice games, playing card games and spinning wheel games. The processor may be configured with software in memory to execute game rules of at least two different games selected from the group consisting of roulette, bingo, dice games, playing card games and spinning wheel games. The processor may be configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

Each wagering environment, which may be a casino or an amphitheater within a casino may include a local area network, which may include an access point from a central server/processor (which may service the single wagering environment or multiple wagering environments), a wagering game server, and the individual player input wagering game systems or terminals. The access point (the I/O connection at the individual wagering environment to the main server/processor) preferably provides wireless communication links, although wired communication links may also be used. The wired and wireless communication links can employ any suitable connection technology, such as Bluetooth, 802.11, Ethernet, public switched telephone networks, SONET, etc. In some embodiments, the wagering game server can serve wagering games and distribute content to devices located in other casinos or at other locations on the communications network.

There may be a content server, game server or central gaming processor that comprises a wagering game three-dimensional animations/image database, an object movement result generator, and a compositing unit. The compositing unit would be coupled with the object movement result generator and with the wagering game animations database. The compositing unit selects one of multiple pre-generated and stored wagering game animations (e.g., dice throw animations, roulette spins, wheel spins, cards dealt, etc.) from the wagering game animations database responsive to initiation of play after wagers have been accepted, so as to present a wagering game animation. The object movement result generator determines an outcome of a wagering game that involves object movement (e.g., a dice throw) and an orientation of the object(s) to be presented by the display stage central to the gaming system. The outcome is randomly determined (e.g., by a random number generator), the final orientation of the object(s) in displaying the event outcome must represent the specifically determined random event outcome. For example, a pre-determined three-dimensional image indicating the dice being randomized (e.g., shaken in a virtual container or in a virtual hand) is provided (e.g., as the generic segment of the display) and then the final orientation of dice for a given outcome of a dice throw is displayed as the final segment. The compositing unit determines, based on the random number generated outcome of the dice throw and the orientation of the dice, a final image display position of the virtual three-dimensional display of the dice. The compositing unit also may constrain the virtual image of the dice in throw animation based on knowledge of the initial state of the virtual dice (which the system may allow an individual player among the multiple players to set the virtual dice as the shooter) to assist in generating the virtual dice throw graphics. The three-dimensional segment or continuous image content server then provides the virtual dice throw graphics to the wagering game machine. It is noted that in some implementations, the content server may comprise a simulation unit that simulates object movement for wagering games subject to parameters that correspond to the object (e.g., a dice throw subject to dice throw parameters and laws of physics to generate the dice throw animation). In other implementations, the wagering game animations may be generated on another server and may be uploaded to the content server.

Embodiments are not limited to implementing functionality of the compositing unit within the content. The content server can select the dice throw animation and can determine the outcome of the dice throw and the orientation of the dice, while the wagering game machine can determine the initial state of the dice and can appropriately constrain the dice to the dice throw animation to generate the dice throw graphics. The wagering game machines described herein can take any suitable form, such as floor standing models, handheld mobile units, table top models, workstation-type console models, etc. Further, the wagering game machines can be primarily dedicated for use in conducting wagering games, or can include non-dedicated devices, such as mobile phones, personal digital assistants, personal computers, etc. In one embodiment, the wagering game network can include other network devices, such as accounting servers, wide area progressive servers, player tracking servers, and/or other devices suitable for use in connection with embodiments of the invention.

In some embodiments, wagering game machines and wagering game servers work together such that a wagering game machine can be operated as a thin, thick, or intermediate client. For example, one or more elements of game play may be controlled by the wagering game machine (client) or the wagering game server (server). Game play elements can include executable game code, lookup tables, configuration files, game outcome, audio or visual representations of the game, game assets, or the like. In a thin-client example, the wagering game server 506 can perform functions such as determining game outcome or managing assets, while the wagering game machine can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server can provide functionality that is not directly related to game play. For example, account transactions and amount rules may be managed centrally (e.g., by the wagering game server) or locally (e.g., by the wagering game machine 502). Other functionality not directly related to game play may include power management, presentation of advertising, software or firmware updates, system quality or security checks, etc.

Any of the wagering game network components (e.g., the wagering game machines) can include hardware and machine-readable media including instructions for performing the operations described herein.

Individual Display Screen or Amphitheater Design

Referring now to FIG. 1, which displays a 3D Holopgraphic amphitheater according to U.S. Pat. No. 8,177,368 a box truss framework 500 comprises a square upper truss work 502 and leg trusses 504. In constructing the framework 500 the upper truss work 502 rests upon a number of jacks 506. First sections 508 of the leg trusses 504 that extend at right angles to the upper truss work 502 are added at the corners of the upper truss work 502. The height of the jacks 506 is increased to allow additional sections 510 of the leg trusses 504 to be added until the desired height of the box truss framework 500 is achieved.

A cross-piece truss 512 is fixed to two of the leg trusses 504 such that it horizontally spans the gap therebetween at a height close to, and typically slightly below, the level of a stage floor 514. The leg trusses 504 spanned by the cross-piece truss 512 constitute the rear legs of the framework 500 and are located adjacent the front of the stage floor 514.

A dust-free protective plastic sheet 515 is laid across the width of the stage floor 514 in front of the rear legs of the framework 500. A roll of screen film 518 is removed from a protective cylindrical casing 520 and is unwound across the width of the stage floor 514. The film 518 is placed upon the sheet 515 in order to prevent damage to the surface from dust particles or other sharp protrusions.

A lower edge 522 of the film 518 is placed between jaws 524*a,b* of a retention member 526, each jaw 524*a,b* having opposed openings therethrough spaced at approximately 0.5 m intervals. Bolts 528 are placed through the openings, and through the film 518, and secured in position using respective nuts. Ratchet straps 532 are attached to the retention member 526 adjacent alternate bolts 528, having a spacing of approximately 1 m, and are then attached to the cross-piece truss 512.

A second retention member 534 is attached to an upper edge 536 of the film 518 in a similar manner to how the retention member 526 is attached to the lower edge 522. Ratchet straps 538 are attached to the second retention member 534.

A rope 540 is tied to the second retention member 534 and is passed over the upper truss work 502 opposite the cross-piece truss 512. The film is raised into position using the rope 540 and the ratchet straps 538 are attached to the upper truss work 502. Both sets of ratchet straps 532, 538 are tightened individually until the screen film is tensioned such that the film 518 is flat and, ideally, free from wrinkles.

A projector 542 is depended from the upper truss work 502 and a pigmented reflective board 544 is placed between the screen 518 and the front edge of the box truss framework 500 such that light emitted by the projector 542 is reflected from the board 544 onto the screen 518. The screen 518 reflects at least part of the light from a front surface thereof away from the stage and into an auditorium to be viewed by an audience.

In order to prevent the audience observing the projection apparatus both side and front drapes 546 are used to screen the apparatus from the audience.

Wagering Game Machine Architectures

Figure 2:
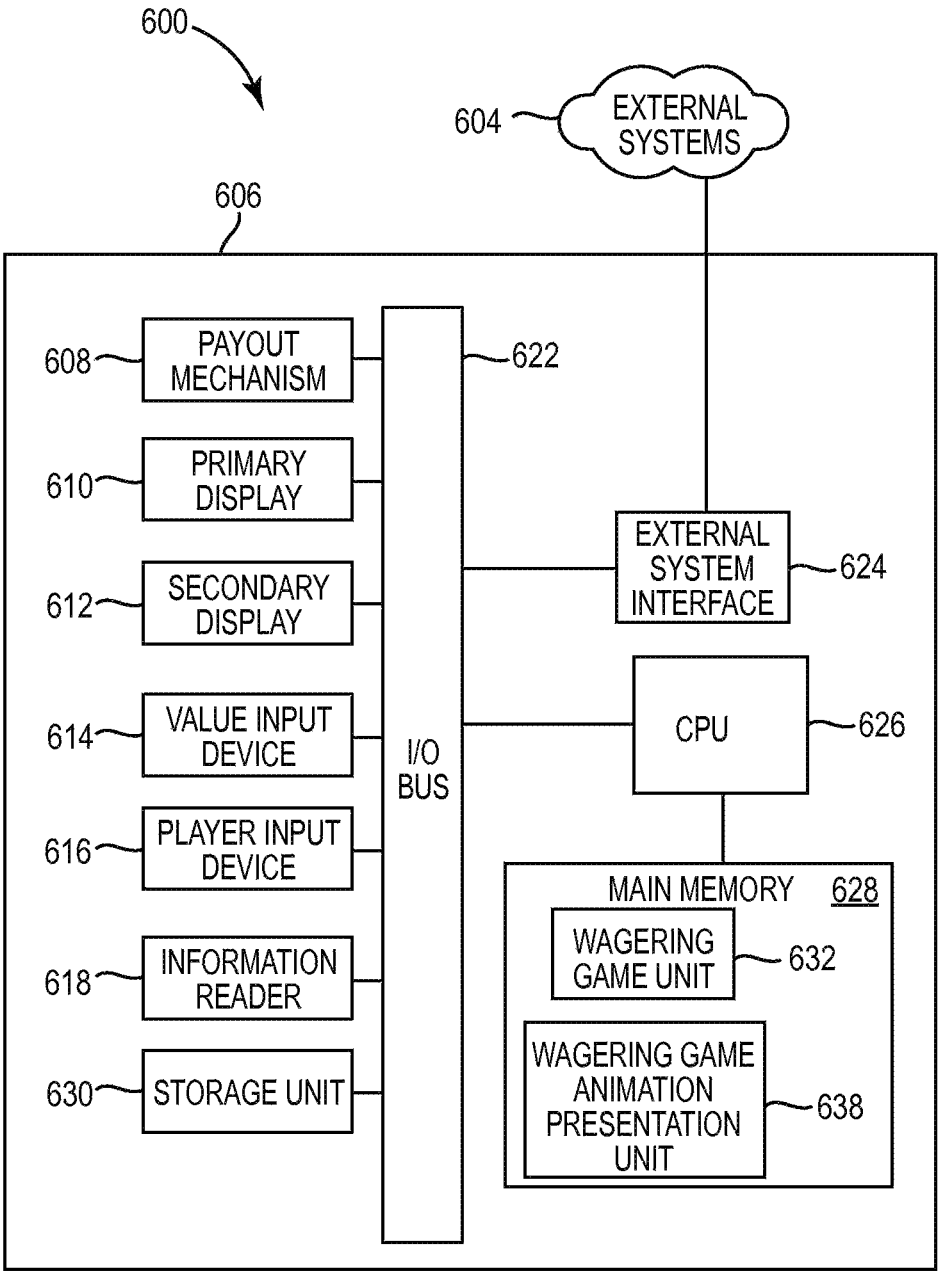
FIG. 2 is a block diagram illustrating wagering game machine architecture 600, according to example embodiments of the invention.

FIG. 2 is a block diagram illustrating Prior Art wagering game machine architecture 600, according to example embodiments of the invention. As shown in FIG. 6, the wagering game machine architecture 600 includes a wagering game machine 606, which includes a central processing unit (CPU) 626 connected to main memory 628. The CPU 626 can include any suitable processor, such as an Intel™ Pentium processor, Intel® Core 2 Duo processor, AMD Opteron® processor, or Ultra SPARC processor. The main memory 628 includes a wagering game unit 632 and a wagering game animation presentation unit 638. In one embodiment, the wagering game unit 632 can present the wagering games described herein, in whole or part.

The wagering game animation presentation unit 638 receives wagering game animations generated by a content server (e.g., the content server described above) and presents the wagering game animations on a primary display 610 and/or a secondary display 612 of the wagering game machine 600 in accordance with instructions from a content server. In some implementations, the main memory 628 may also comprise a compositing unit. The compositing unit can receive, from the content server, a template animation, a randomly generated wagering game outcome, and an orientation of an object(s) of the wagering game. The compositing unit can generate the wagering game animation and present the wagering game animation on the primary display 610 and/or the secondary display 612 of the wagering game machine 600 based on the template animation, the outcome, and the orientation of the object(s).

The CPU 626 is also connected to an input/output (I/O) bus 622, which can include any suitable bus technologies, such as an AGTL+ frontside bus and a PCI backside bus. The I/O bus 622 is connected to a payout mechanism 608, the primary display 610, the secondary display 612, value input device 614, player input device 616, information reader 618, and storage unit 630. The player input device 616 can include the value input device 614 to the extent the player input device 616 is used to place wagers. The I/O bus 622 is also connected to an external system interface 624, which is connected to external systems 604 (e.g., wagering game networks).

In one embodiment, the wagering game machine 606 can include additional peripheral devices and/or more than one of each component shown in FIG. 6. For example, in one embodiment, the wagering game machine 606 can include multiple external system interfaces 624 and/or multiple CPUs 626. In one embodiment, any of the components can be integrated or subdivided.

Any component of the architecture 600 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). Machine-readable media can be machine-readable storage media or machine-readable signal media. Examples of machine-readable storage media include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. Examples of machine-readable signal media can be in the form of an electro-magnetic signal, an optical signal, or any suitable combination thereof.

A graphical user interface (GUI) is a type of computer application user interface that allows people to interact with a computer and computer-controlled devices. A GUI typically employs graphical icons, visual indicators or special graphical elements, along with text, labels or text navigation to represent the information and actions available to a user. The actions are usually performed through direct manipulation of the graphical elements.

Holographic images can be created as single or consecutive images using available holographic technology. These technologies include mirrors, lasers, light and images strategically positioned to cause the proper reflection to yield a holographic image broadcast through an entry point in the laser and mirror positioning system. Black background and rooms with low or no light may enhance the appearance of the holographic image or images, which may also use a holographic plate as a display medium. Holographic systems may be large in size and spread out over a large broadcasting area or may be compact enough to fit in spaces smaller than a desk top. Holographic technology is only limited in size by the size of the component parts. By using holographic technology, images may be displayed multi-dimensionally, rather simply on a planar projection.

Currently progress has been made in technologies that can enhance the capability and range of holographic media in projects that employ multi-million mirror systems and via companies that have designed specialized high speed and high capacity micro processors for specialized jobs, other than holographic systems, where the technology could be applied to holographic technologies to make possible the proper positioning of millions of mirrors at a rate of between 24 to 60 or more frames of video per second, with corresponding synched audio.

Holographic displays generated over the last 20-year period utilize various configurations including lasers with images on glass plates such as an AGFA 8E75HD glass plate or other glass plates as well a laser such as a Spectra Physics 124B HeNe laser, a 35 mW laser diode system utilizing different processing methods such as pyrochrome processing. Split beam techniques can also be used Multi H1 to Multi H2. Such configurations as 8.times.10, triethanolomine, from Linotronic 300 image setter film are also commonly utilized or a configuration with rear-illuminated for 30.times.40 cm reflection hologram, where a logo floats 18-inches in front of the plate.

Figure 3:
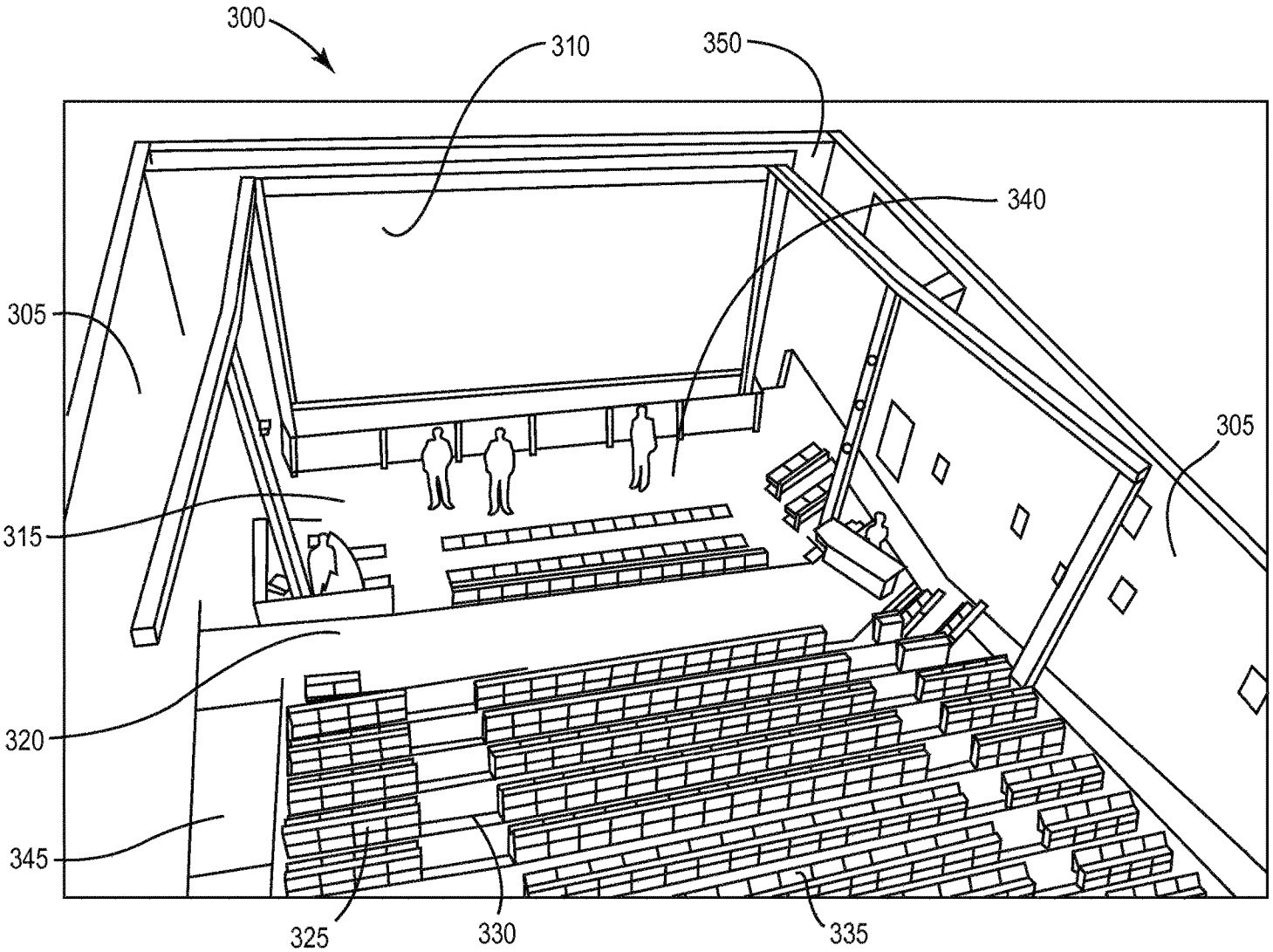
FIG. 3 is a perspective overview of an example of an enclosed theater system with seating for engaging in three-dimensional systems according to the present technology.

FIG. 3 is a perspective overview of an example of an enclosed theater system 300 with seating 325, 335 for engaging in three-dimensional systems according to the present technology. The screen 310 is positioned with walk spaces 315, 340, 320, 345 and 330 distributed about the seating 325 and 335. Walls 305 enclose the theater system 300. Space between the screen 310 and a back frame/wall system 350 can be used to store apparatus (not shown) used in creating the three-dimensional gaming images used within the scope of the present technology.

Published US Patent Application Document No. 20090109175 describes a system for a 3 dimensional (3-D) user interface comprises: one or more 3-D projectors configured to display an image at a first location in a 3-D coordinate system; one or more sensors configured to sense user interaction with the image and to provide user interaction information; and a processor configured (i) to receive the user interaction information from the one or more sensors; (ii) to correlate the user interaction with the image; and (iii) to provide one or more indications responsive to a correlation of the user interaction with the image, wherein the one or more indications comprise displaying the image at a second location in the 3-D coordinate system. A method for providing a 3-D user interface comprises: generating an image at a first location in a 3-D coordinate system; sensing user interaction with the image; correlating the user interaction with the image; and providing one or more indications responsive to a correlation of the user interaction with the image, wherein the one or more indications comprise displaying the image at a second location in the 3-D coordinate system. Computer readable program codes related to the system and the method of the present invention are also described herein. This progressive display of pre-enabled holographic displays is less preferred in the practice of the present technology, but must be considered as an optional embodiment herein. In this technology, some user interfaces have adopted a multi-dimensional interface approach. For example, the "heliodisplay" of IO2 Technology, LLC of San Francisco, Calif. projects images into a volume of free space, i.e. into an aerosol mixture such as fog or a gas, and may operate as floating touchscreen when connected to a PC by a USB cable. However, with the heliodisplay, the image is displayed into two-dimensional space (i.e. planar). While the Heliodisplay images appear 3 dimensional ("3-D"), the images are planar and have no physical depth reference. Unfortunately, these existing uses have certain limitations in distribution and deployment. For example, functionally, the heliodisplay is a two dimensional display that projects against a curtain of air, or even glass. While, the heliodisplay may give the appearance of 3-D, the images displayed and the interface are 2-D. As such, the heliodisplay is not a true 3-D holographic display, and thus the interface operates on a two-dimensional plane, not taking advantage of a full three dimensional coordinate system.

Accordingly, one would likely use an integrated user interface that utilizes true 3-D technology to create a computing and multimedia environment where a user can easily navigate by touch, mouse or pointer system to effectively navigate the interface to raise the level of the user experience to a true 3-D environment, with the goal of attaining elements of the attenuated clarity, realism and benefits of that environment that match our day to day conventional interactions with the 3-D world. The present invention relates to the creation of a holographic user interface display system that combines physical media or digitally stored files with a digital holographic player hardware system. The result is the creation of a multimedia holographic user interface and viewing experience, where a variety of graphical schematics enabling cohesive access to information utilizing pyramids, blocks, spheres, cylinders, other graphical representations, existing templates, specific object rendering, free form association, user delegated images and quantum representations of information to form a user interface where the available tools combine over time to match a user's evolving data and requests.

Figure 4:
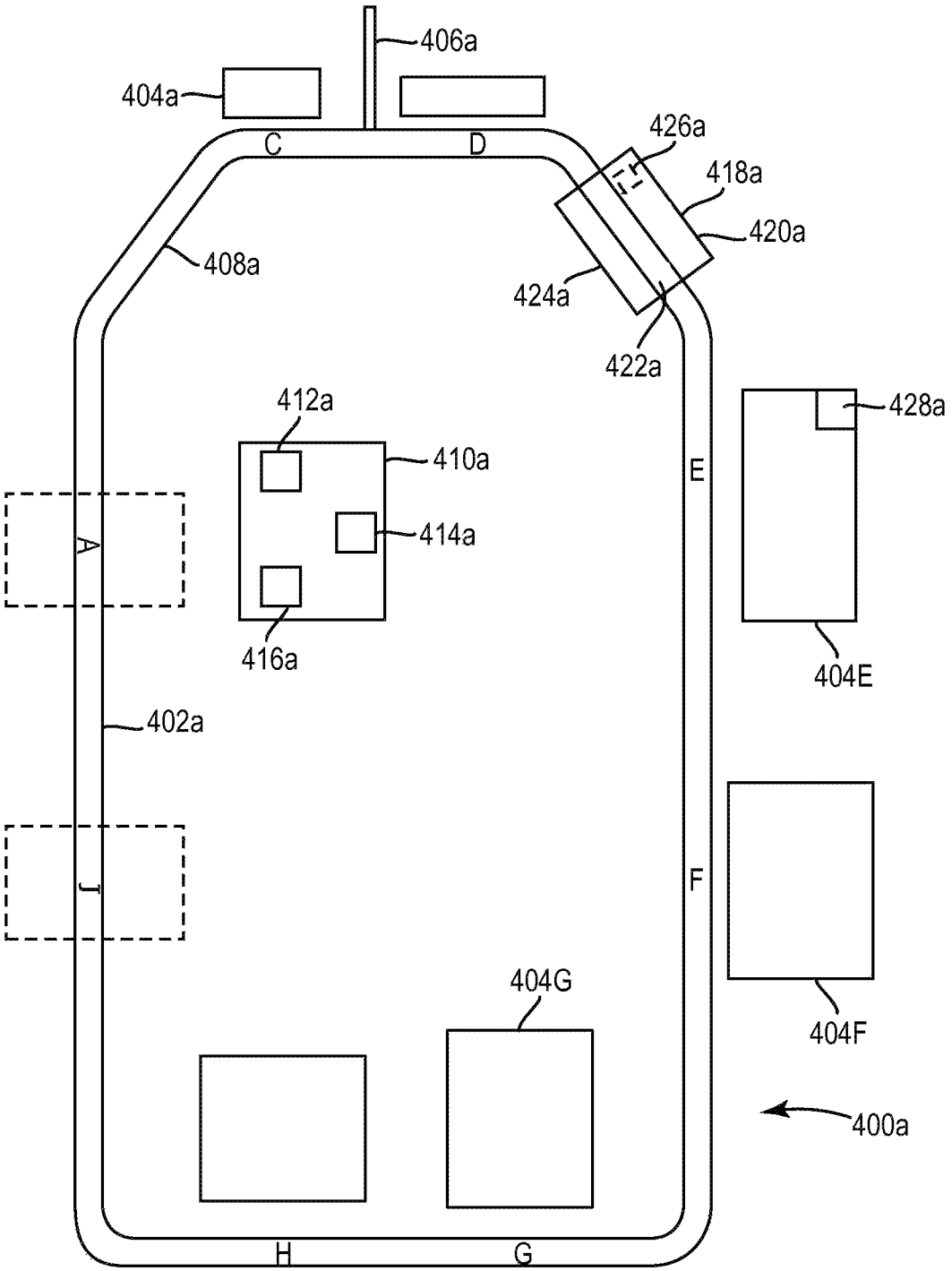
FIG. 4 is an overhead view of a track system with distinct multiple display screens.

FIG. 4 is an overhead view of a track system 400*a* with distinct multiple display screens 404*a*. The system 400*a* is shown with a two-rail track 408*a* that forms a complete continuous circuit, beginning at a user entry position A and ending at a user exit position I. A carriage 418*a* with three rows of user seating 420*a*, 422*a* and 424*a* is shown moving along the track 408*a*. When the carriage 418*a* (there will of course likely be multiple carriages on the track 408*a* at any one time, as previously described) is at the player/user entry position A, that is a preferred point at which data entry into the theme to be displayed or the gaming content to be used should be entered into a processor (game control or central game or theme or shown control processor 412*a*). A central processing station 410*a* is shown which houses, e.g., the central processor 412*a* and optionally also separate carriage control processor 414*a* and separate game content control or image content control processor 416*a*, each with sufficient memory and functionality therein to perform its functions). These processors are in communication with processors 426*a* (on the carriage 418*a*) and processor 428*a* on the display screens (e.g., 404E).

The individual carriages 418*a* move around the track 408*a* stopping at each theater position stop point C, D, E, F, G and H for providing passengers on the carriage 418*a* with a review of the respective display screens (e.g., 404E) at the respective stop points. The carriages 418*a* must be configured and aligned so that a each stop point C, D, E, F, G and H, each user on the rows o seating 420*a*, 422*a* and 424*a* will have a good view and, in the case of three-dimensional or holograph displays, will be oriented so that the light from the respective display will provide a quality image.

Note that in FIG. 4, some of the display screens (e.g., 404F and 404G) are shown on opposite sides of the track 408*a*. If this orientation is used, the carriage should be able to revolve on a central access to pivot the forward viewing face of the rows of seats 420*a*, 422*a* and 424*a* of the carriage 418*a* towards the appropriate display screen. This formatting of orientation of screens can reduce any possibility of image overflow from the field of view of users with respect to adjacent screens and enable the display screens 404*a* to be closer together, saving space.

Figure 5:
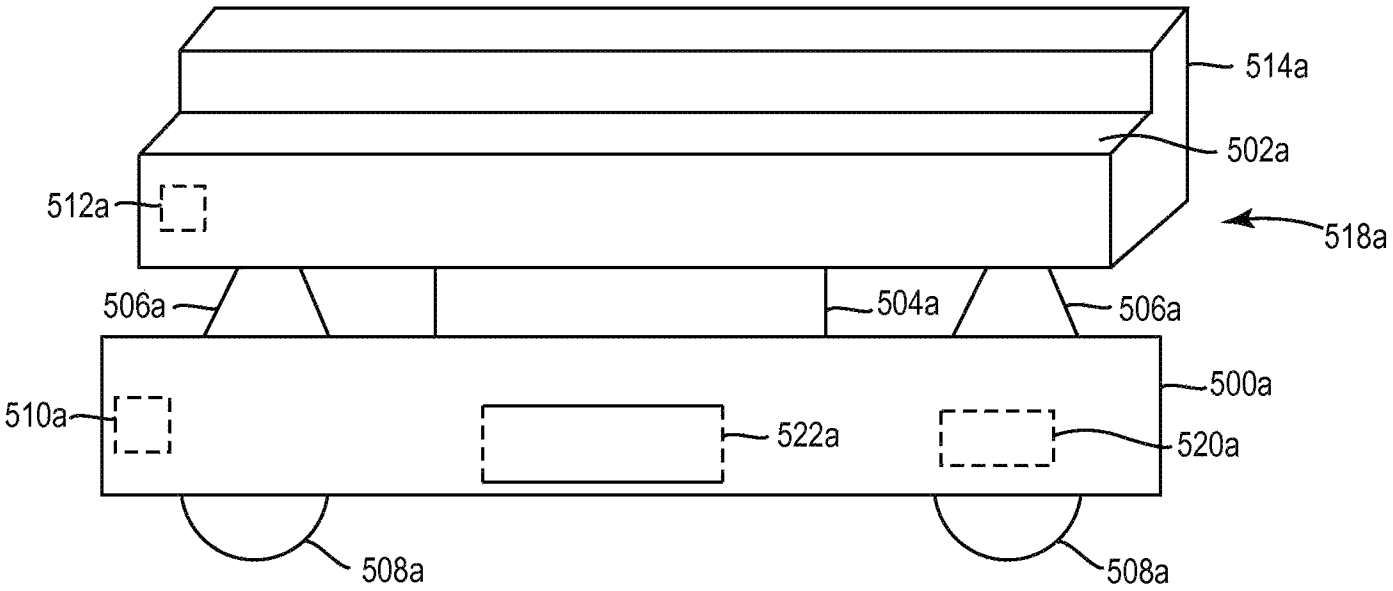
FIG. 5 is a side view of a carriage with carriage support frame in a partially rotated and aligned position.

FIG. 5 is a side view of a carriage 518*a* with carriage support frame 502*a* with the seating area 512*a* in a partially rotated and aligned position. There is a central pivoting support 504*a* and two end glides 506*a* to assist in supporting the seating area 502*a* during rotation to assist in orientation of the seating area 502*a* with respect to view screens (not shown). A set of wheels 508*a* for engagement with the tracks (not shown) is on the base of the carriage support frame 502*a*. The seating area 502*a* is shown with the forward view right side 516*a* shown rotated slightly forward to align the seating area 502*a* with any screen (not shown). Sensors 510*a* and 512*a* are shown on the carriage support 500*a* and the seating area 512*a*, respectively. A processor 520*a* for the carriage 518*a* and a motor 520*a* for the wheels 506*a* are shown.

With respect to the relative ability of the seating area 512*a* to rotate with the respect to the support frame 502*a*, that relative rotation should be at least 180°, more preferably at least 270° and up to 360°. Any more rotation (e.g., completely free an continuous rotation) tends to be superfluous, but may be used.

The present technology includes a method for providing virtual entertainment to multiple players on a carriage at multiple holographic viewing positions. The method may include:

- moving at least one carriage having seating for multiple passengers along a track system that is configured to support and direct multiple carriages and convey the multiple carriages through a sequence of multiple viewing screens;
- the multiple viewing screens each displaying a holographic thematic events from feed from a processor;
- a processor accessing memory containing both a store of more than one theme and multiple holographic data content for display on separate screens, and the processor transmitting upon demand holographic video information related to a single theme to each of the video display screens;
- input from a signal input system directing the processor to provide a signal identifying a single theme from among the more than one theme for display to a single carriage as it moves along the track system;
- the processor identifying location of individual ones of the multiple carriages with respect to individual respective ones of the viewing screens; and
- the processor providing thematic content of the single theme identified to the individual respective ones of the multiple carriages for display to each of the at least two players in the individual respective ones of the multiple carriages.

The input from a signal input system may direct the processor to provide only a single field of thematic content to each carriage as it moves through along the entire track system, or the input from a signal input system may direct the processor to provide multiple fields of thematic content to each carriage as it moves through along the entire track system. The field of thematic content may be interactive wagering on games managed by the processor, with gaming content displayed on the multiple viewing screens as described above.

As can be seen, there is a significant amount and variety of formats and content that may be used in the practice of the present technology. The specific descriptions provided are to be considered as examples within the generic scope of the invention.

What is claimed:

1. A multi-player gaming system comprising:

a plurality of viewing screens, each screen displaying gaming content comprising at least one of a gaming event and a gaming outcome;

a plurality of carriages, wherein each carriage comprises seating for two or more players;

player input controls configured to receive wagering input from at least one player within each of the plurality of carriages;

a track system to move the plurality of carriages through a sequence of the plurality of viewing screens;

a processor;

a memory communicatively coupled to the processor, the memory bearing instructions that, when executed on the processor, cause the system to at least:

receive, from the player input controls, wagering input from a player within a first carriage of the plurality of carriages;

determine a location of the first carriage along the track system;

identify a viewing screen associated with the location of the first carriage; and provide gaming content to the identified viewing screen based on the received wagering input.

2. The system of claim 1, wherein the player input controls receive multiple wagering inputs.

3. The system of claim 2, wherein the player input controls are configured to receive multiple wagering inputs from two or more players within the first carriage.

4. The system of claim 1, wherein the gaming content is provided after the carriage is positioned in front of the identified viewing screen.

5. The system of claim 1, wherein player input controls are configured to receive input at one or more specific locations along the track system.

6. The system of claim 1, wherein the track system comprises a monorail, a dual track, or multiple tracks.

7. The system of claim 1, further comprising:

a rotatable frame to support each carriage, and position each carriage towards each viewing screen throughout the sequence.

8. The system of claim 1, wherein a single format of gaming content or multiple formats of gaming content are provided throughout the sequence of viewing screens.

9. The system of claim 1, wherein the gaming content includes one or more images relating to a theme.

10. The system of claim 9, wherein the theme is at least one of: animals, sports activity, plant displays, scenery, science exhibits, decorated rooms, and entertainment acts.

11. The system of claim 1, wherein the gaming content is random outcome wagering events.

12. The system of claim 1, wherein the viewing screens support holographic data content related to the gaming content.

13. A method for providing a multi-player virtual entertainment game, comprising:

moving a plurality of carriages along a track system through a sequence of a plurality of viewing screens, wherein the plurality of carriages move along the track system via a set of wheels configured to engage with the track system, wherein each carriage comprises seating for two or more players, and wherein each of the plurality of viewing screens display gaming content comprising at least one of a gaming event and a gaming outcome;

using player input controls to receive wagering input from at least one player within a first carriage of the plurality of carriages, wherein the player input controls are configured to receive wagering input from at least one player within each of the plurality of carriages, wherein a memory is communicatively coupled to a processor and the memory bears instructions that, when executed on the processor, cause the player input controls to receive wagering input;

determining a location of the first carriage along the track system, wherein the memory bears instructions that, when executed on the processor, cause the processor to determine the location;

identifying a viewing screen associated with the location of the first carriage, wherein the memory bears instructions that, when executed on the processor, cause the processor to identify the viewing screen; and providing gaming content to the identified viewing screen, based on the received wagering input, wherein the memory bears instructions that, when executed on the processor, cause the processor to provide gaming content to the identified viewing screen.

14. The method of claim 13, wherein the viewing screens are configured to display holographic video content.

15. The method of claim 13, wherein the gaming content comprises thematic random outcome wagering events.

16. The method of claim 13, wherein the gaming content comprises interactive wagers related to content displayed on multiple viewing screens.

17. The method of claim 13, wherein the wagering input is received from two or more players within the first carriage.

18. The method of claim 13, wherein the gaming content is provided after the carriage is positioned in front of the identified viewing screen.

19. The method of claim 13, wherein the carriage comprises at least two tiers of seating.

20. The method of claim 13, wherein player input controls are configured to receive input at one or more specific locations along the track system.

* * * * *